United States Patent [19]

Danford

[11] 4,313,706

[45] Feb. 2, 1982

[54] GRAIN CAKE BREAKER

[75] Inventor: Jack D. Danford, Box 98, Watkins, Colo. 80137

[73] Assignees: Jack D. Danford; H. H. Champlin, both of Watkins, Colo.

[21] Appl. No.: 145,972

[22] Filed: May 2, 1980

[51] Int. Cl.[3] ..... B65G 65/00; B65G 3/00

[52] U.S. Cl. ..... 414/326; 241/283; 366/603; 366/332; 414/325; 222/233

[58] Field of Search ..... 414/311, 312, 324, 325, 414/326, 306, 304, 305, 297; 366/603, 184, 332; 241/283; 222/233, 234, 228, 243–246

[56] References Cited

U.S. PATENT DOCUMENTS 2,187,587 1/1940 Kehl ..... 241/283

4,161,255 7/1979 Ropert ..... 414/325 X

*Primary Examiner*—George E. A. Halvosa

*Assistant Examiner*—L. E. Williams

*Attorney, Agent, or Firm*—Fields, Lewis, Pittenger and Rost

[57] ABSTRACT

A grain cake breaker device is provided for placement within a storage bin to facilitate the removal of grain therefrom. The device includes a support structure having a number of legs which are connected to the storage bin floor at their lower ends. The legs converge together at their upper ends where they are joined with a hydraulic cylinder. The hydraulic cylinder is connected to a shaft which extends downwardly toward the bottom of the storage bin. A plurality of nonrotatable, rigid cutting arms extend outwardly and upwardly from the shaft. When the hydraulic cylinder is powered, the shaft moves in a substantially vertical reciprocal direction so that the cutting arms loosen caked grain when contacted by the cutting arms. The grain then flows to the bottom of the storage bin where it is carried from the storage bin by a conveyor.

9 Claims, 9 Drawing Figures

GRAIN CAKE BREAKER

FIELD OF THE INVENTION

This invention relates to devices for loosening caked materials and, in particular, to a device which separates caked granular particles stored in a bin.

BACKGROUND ART

A number of devices for alleviating the problem of removing caked grain from a storage bin have been disclosed. In U.S. Pat. No. 3,223,290 to Schuld, an agitating device is described which includes a number of flexible chains mounted on a shaft. The device is placed in a grain storage bin having a tapering bottom portion. The shaft rotates about a vertical axis and the chains rotate outwardly and upwardly due to centrifugal forces in order to break up any caked grain in the storage bin. In U.S. Pat. No. 3,666,117 to Gessler, a silo discharging device is disclosed comprising a rotary cutter displaced between a pair of separately driven conveyors. The rotary cutter rotates about a vertical axis and has a pair of leaf spring formed cutters for breaking grain as the rotary cutter rotates so that any caked grain can be received by the conveyors. In U.S. Pat. No. 3,499,556 to Broberg, a relatively complicated unloading mechanism is disclosed. The mechanism includes a rotatable cutter adapted to be driven within the silo to loosen caked grain so that the grain is removable by an auger. In U.S. Pat. No. 4,139,106 to Tartar, an unloading device is described having a conical or pyramidal deflector positioned in a silo. The deflector is spaced inwardly from the interior wall of the silo to define a corridor. A plurality of scrapers move along the corridor to carry stored materials into a discharge passage.

SUMMARY OF THE INVENTION

In accordance with the present invention, a grain breaking device is provided which includes a shaft having a plurality of cutting arms extending outwardly therefrom. The shaft is joined to a hydraulic cyclinder which is powered by a hydraulic power source. The hydraulic cylinder is mounted on a support structure comprising a number of equally spaced legs. The grain breaking device is positioned within a bin prior to being filled with grain. When it is desirable to remove the grain, the hydraulic cylinder is actuated so that the shaft moves in a vertical direction. The cutting arms loosen the grain during this vertical movement to facilitate the flow thereof to a conveyor located at the bottom of the bin.

More particularly, the grain breaking device of the present invention includes a support structure having four equally spaced legs. The legs are connected to the bottom floor of a storage bin and each leg includes a telescopic feature which permits each leg to be adjusted to different heights. The legs converge together above the bin floor to be joined together at their upper portions within the confines of the storage bin. A hydraulic cylinder is mounted on the support structure at the upper portions of the legs. The hydraulic cylinder includes a movable rod which extends and retracts upon application of power to the hydraulic cylinder. The rod is joined to a shaft which is positioned generally in the center of the storage bin. A plurality of longitudinally spaced, rigid cutting arms are adjustably mounted on the shaft. The cutting arms extend outwardly and upwardly from the shaft and each of the cutting arms includes a plurality of blades. An additional cutting arm is connected to the bottom of the shaft so that it can be positioned just above a conveyor. In operation, the hydraulic cylinder is powered by a hydraulic power source exterior to the storage bin which results in the vertical, nonrotational movement of the shaft and cutting arms. This vertical movement or vibration loosens any grain which may have caked during storage. Upon loosening, the grain readily flows to the conveyor which carries the grain from the bin.

In view of the foregoing description, it is readily seen that the present invention affords a number of worthwhile advantages. A relatively simple device, yet highly efficient in operation, is provided for breaking caked grain into smaller particles. The device is easily assembled in the storage bin and the hydraulic cylinder can be powered by an external hydraulic power source, such as is found on a tractor or truck. The support structure and cutting arms are adjustably positioned to locate the cutting arms at different heights within the storage bin. A number of additional benefits of the present invention will become readily apparent from the following description taken in conjunction with the accompanying drawings.

DESCRIPTION OF THE PREFERRED EMBODIMENT

Figure 1:
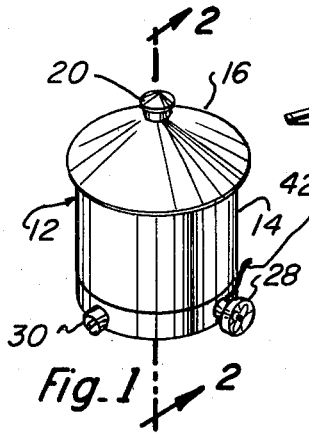
FIG. 1 is a perspective view of a storage bin having a conveyor extending therethrough for use with the present invention.
Figure 2:
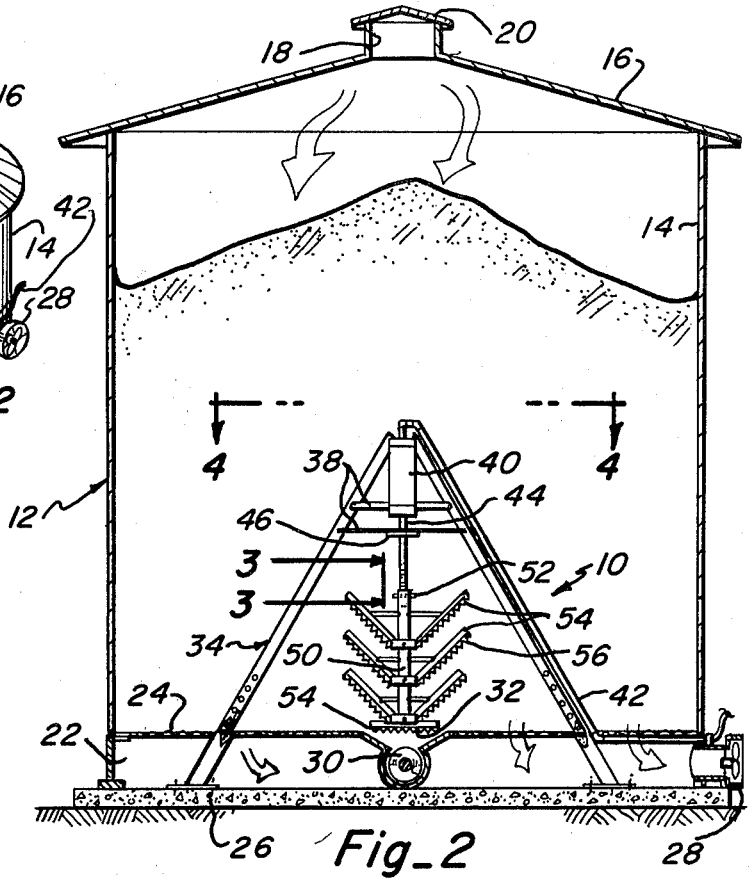
FIG. 2 is an enlarged, longitudinal section, taken along line 2—2 of FIG. 1, showing the storage bin and grain cake breaker device contained therein.

In accordance with this invention, a grain cake breaker device 10 is provided for placement within a bin 12 as seen in FIGS. 1 and 2. The bin 12 includes a generally cylindrical housing 14 for storing solid particles and, in particular, harvested grain. A top member 16 of the bin 12, generally coneshaped, connects to the housing 14. An inlet 18 is formed in the top member 16 for receiving the grain while a cap member 20 covers the inlet 18 during the storage period.

In the embodiment depicted in FIG. 2, the bin includes an air space 22 formed between bin floor 24 and base floor 26 of bin 12. The base floor 26 directly overlies the ground supporting surface and is made of any convenient supporting material, such as concrete. At one end of the air space 22 is positioned fan 28. Fan 28 is operated to draw air from the housing 14 to minimize the presence of moisture in the housing 14. A conveyor 30 is also located between the bin floor and the base floor and extends through the housing 14 to carry grain from the housing 14. The conveyor is normally positioned along a diameter of the cylindrical housing 14 and at right angles to the fan 28. An opening 32 is formed in the bin floor 24 so that the conveyor 30 has access to the grain.

Figure 3:
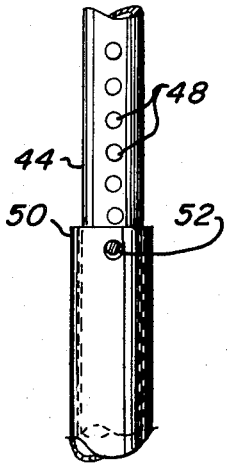
FIG. 3 is an enlarged, fragmentary, longitudinal section, taken along line 3—3 of FIG. 2, showing the adjustable feature of the shaft of the grain cake breaker device.
Figure 4:
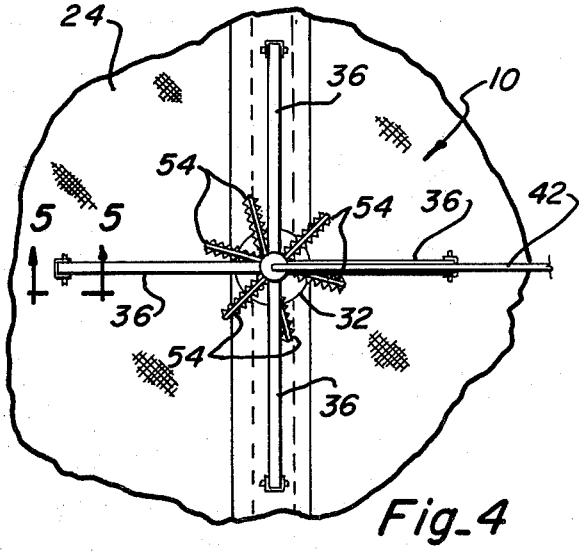
FIG. 4 is a fragmentary, top plan view, taken along line 4—4 of FIG. 2, showing the supporting legs and cutting arms of the grain cake breaker.

The grain cake breaker device 10 is placed in the bin 12 prior to filling the bin 12 with grain. The device 10 includes a support structure 34 which includes four legs 36, as seen in FIG. 4. The legs 36 are spaced equidistantly from each other, approximately 90° apart, and the lower portions of the legs 36 are connected to the bin 12 while their upper portions converge together. The leg upper portions converge together along the longitudinal axis of the cylindrical housing 14 which extends through the center of housing 14. The support structure 34 is reinforced by means of braces 38 connected between the legs 36 adjacent their upper portions. A hydraulic cylinder 40 is connected to the legs 36 adjacent their upper portions and extends vertically downwardly. A hose 42 communicates at one end with the hydraulic cylinder 40 and carries fluid thereto. The hose 42 extends along one of the legs 36 into the air space 22 and exits the housing 14 adjacent the fan 28. The other end of the hose 42 communicates with a source of hydraulic power (not shown) from a tractor or truck, for example. The hydraulic cylinder 40 includes a rod 44 which extends downwardly towards the bottom of the bin 12. Rod 44 is supported in bearing 46. The rod 44 includes a number of channels 48 formed laterally therethrough. A shaft 50 having a greater inside diameter than the outside diameter of rod 44 is telescopically adjustable about rod 44 so that the shaft 50 can be connected at one of a number of convenient locations along rod 44, as illustrated in FIG. 3, by inserting pin 52 through one of the channels 48 and an opening in the upper end of shaft 50.

A plurality of cutting arms 54, each having a number of blades 56 extending downwardly from the underside of the cutting arms 54, are fastened along the shaft 50. The cutting arms 54 are equally spaced from each other along the longitudinal extent of the shaft 50 while extending outwardly and upwardly therefrom. As depicted in FIG. 4, in addition to being equally spaced from each other in a generally vertical direction, each cutting arm 54 forms an angle of approximately 60° with its adjacent cutting arm 54. It is also understood that the connection of the cutting arm 54 to the shaft 50 can be adjusted so that the cutting arm 48 can be placed at different points along the shaft 50. An additional cutting arm 54 is connected to the lower end of the shaft 50 immediately above the conveyor 30.

Figure 5:
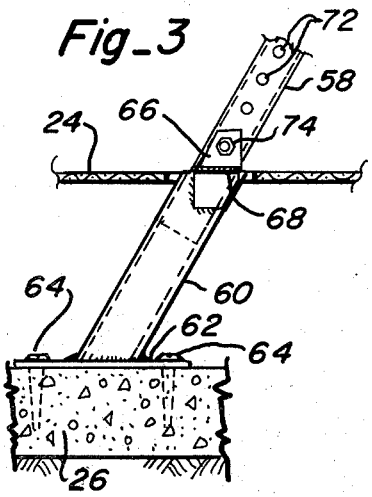
FIG. 5 is an enlarged, fragmentary, longitudinal section, taken along line 5—5 of FIG. 4, showing details of the leg connection to the storage bin.
Figure 6:
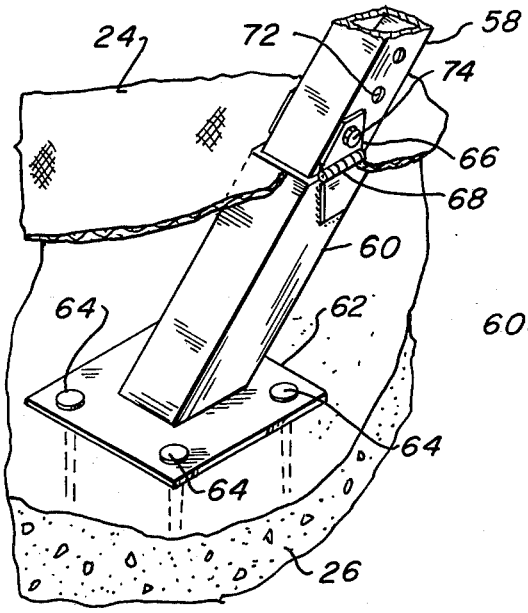
FIG. 6 is an enlarged, fragmentary, perspective view showing a connection of the supporting leg of the support structure to the storage bin.
Figure 7:
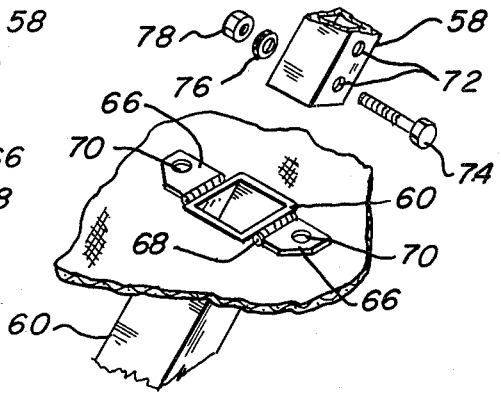
FIG. 7 is an exploded view of portions of the connection of FIG. 6.

Referring now to FIGS. 5–9 to discuss the connection of the support structure 34 to the bin 12, it is seen that each leg 36 includes an inner member 58 and an outer member 60. As depicted in FIGS. 5 and 6, outer member 60 is fastened to base floor 26 by means of plate 62 and fasteners 64 inserted through plate 62 into the base floor 26. Referring in particular to FIG. 7, outer member 60 is hollow and has an inner perimeter of a greater dimension than the outer perimeter of inner member 58 so that inner member 58 can telescope within outer member 60. A pair of flanges 66 are connected by means of hinge members 68 to opposite sides of the outer member 60 adjacent its top portion. Each flange 66 includes an opening 70 aligned with one of a number of holes 72 formed in inner member 60. After aligning one of the holes 72 with the flange opening 70, a bolt 74 is inserted therethrough to fasten the inner member 58 to the outer member 60 by means of a washer 76 and a nut 78. The upward extent of the legs 36 of the support structure 34 can be adjusted by selecting different inner member holes 72 to align with the flange opening 70. Since both the legs 36 and shaft 50 are telescopically adjustable, when the legs 36 are extended in an upwardly direction, the shaft 50 can be moved in a downwardly direction. Conversly, when the legs 36 are retracted in a downwardly direction, the shaft 50 can be adjusted in an upwardly direction.

When it is desirable to remove the support structure 34 from the bin 12, it is a simple task to remove each of the bolts 74 and separate the inner member 58 from the outer member 60. The flanges 66 rotate about hinge member 68 to lie parallel relative to the bin floor 24 and extend outwardly or away from inner member 58. As a consequence, cleaning of the bin 12 after removal of the grain is facilitated inasmuch as the device used to clean the bin 12 is not impeded by support structure parts extending upwardly from the bin floor 24.

Figure 8:
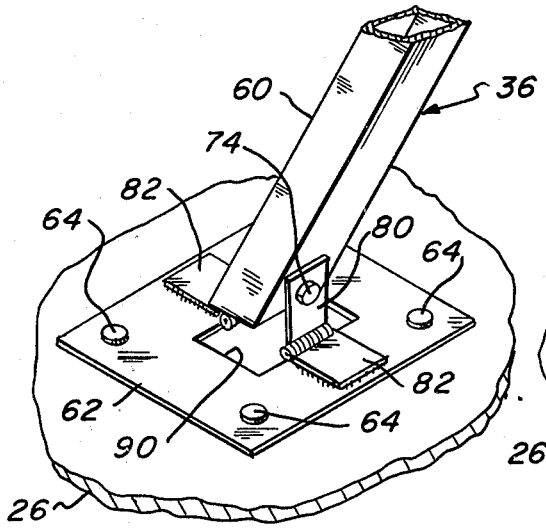
FIG. 8 is an enlarged, fragmentary, perspective view showing another embodiment for connecting the supporting legs of the grain cake breaker device to the storage bin.
Figure 9:
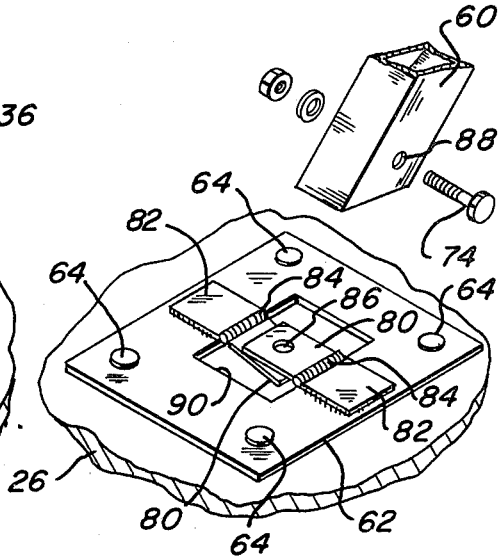
FIG. 9 is an exploded view of portions of the connection of FIG. 8.

Another embodiment for attaching the support structure 34 to the bin 12 is illustrated in FIGS. 8 and 9. In those types of storage bins 12 which do not include an air space 22, a plate 62 is attached to the base floor 26 by means of fasteners 64. Rather than fixedly attaching the outer member 60 to the plate 62 as shown by the embodiment of FIG. 5, the outer member 60 is removably connected to the plate 62 by means of a pair of gates 80, each of which is hinged to a web 82 by a pivot member 84, similar to the flange arrangement previously described. Web 82 is fixedly joined to plate 62. Each gate 80 has an aperture 86 for alignment with a bore 88 formed in outer member 60. A bolt 74 is inserted through the gate aperture 86 and bore 88 while a washer 76 and a nut 78 are used to hold the bolt 74 in place thereby securing the leg 36 of support structure 34 to the base floor 26. As depicted in FIG. 9, when it is desirable to remove the support structure 34 from the bin 12, it is a relatively simple matter to remove the bolt 74 from each of the legs 36. Upon removal, the gates 80 are swung toward each other to overlie one another above a cut-out region 90 in the plate 62. In this position, the gates 80 do not extend upwardly from the base floor 26 and, consequently, do not impede the cleaning of the storage bin 12 after removal of the grain.

In operation, the grain cake breaker device 10 is placed within the storage bin 12. The bin 12 is then filled with grain. At the completion of the storage period, during which time some of the grain has caked together, the hydraulic hose 42 is connected to a hydraulic power source located externally of the bin 12. The hydraulic cylinder 40 is activated to cause reciprocal movement of the shaft 50 in a generally vertical direction. At the same time the cutting arms 54 move in a generally vertical direction. There is no rotational movement of the shaft 50 or cutting arms 54. When the blades 56 engage the grain in the bin 12 during their movement, the caked grain is broken up or loosened into relatively fine particles. In addition, the generally radial arrangement of the cutting arms 54 relative to the shaft 50 maximizes the contact between the blades 56 and the grain. The conveyor 30 is also operated at the same time as the shaft 50 so that grain is carried from the bin 12 as the uncaked grain flows downwardly to the conveyor 30 through the bin floor opening 32. The cutting arm 54 immediately above the conveyor 30, generally transverse to the longitudinal extent of the conveyor 30, acts to loosen any grain which may have caked on the conveyor 30.

In view of the foregoing description, the present invention provides a number of benefits for use with a storage bin. The grain cake breaker is easily assembled and removed from a storage bin. The device is hyraulically operated by readily accessible hydraulic power sources. The device loosens the grain by means of cutting arms moving in a generally vertical direction, rather than rotating in a circular path. The positions of the cutting arms relative to the height of the bin are adjustable. The supporting legs are also telescopically adjustable so that the upward extent of the legs can be adjusted to conform with any adjustment made in the position of the cutting arms. This invention can be used in both a storage bin having an air space at its bottom floor and in a bin which does not include an air space. The grain cake breaker of the present invention can also be used in a storage bin at the same time with other devices which loosen grain.

Although the present invention has been described with reference to a plurality of embodiments thereof, it is readily appreciated that other variations and modifications can be effected within the spirit and scope of this invention.

I claim:

1. An apparatus for breaking up grain cake in a grain storage bin of the type including a housing, a base floor, a bin floor for supporting grain in the bin spaced above the base floor, a conveyor located between the base floor and the bin floor extending across the bin and through the housing for discharging grain from the bin, and at least one opening in the bin floor above the conveyor through which grain from the bin is fed to the conveyor, said apparatus including:

a support structure positioned within the storage bin;

hydraulic means mounted on said support structure;

a shaft coupled to said hydraulic means so that, upon activation of said hydraulic means, said shaft reciprocally moves in a substantially vertical direction; and a plurality of rigid cutting arms connected along said shaft, said cutting arms extending outwardly from said shaft to reciprocally move with said shaft for loosening grain cakes that form above the opening in the bin floor so that a continuous flow of grain to the conveyor is provided.

2. The apparatus, as claimed in claim 1, wherein:

said shaft is moveable only in a substantially vertical direction.

3. The apparatus, as claimed in claim 2, wherein:

said cutting arms extend generally radially and upwardly from said shaft.

4. The apparatus, as claimed in claim 1, wherein:

said cutting arms are rigid and adjustable along the longitudinal extent of said shaft.

5. The apparatus, as claimed in claim 1, wherein:

the longitudinal extent of one of said cutting arms is substantially parallel to the bin floor and transverse to the longitudinal extent of the conveyor to facilitate movement of the grain immediately adjacent the conveyor.

6. The apparatus, as claimed in claim 1, wherein:

said support structure includes a number of legs adjustable in length, each of said legs having an upper portion and a lower portion, each of said legs converging together at their upper portions for connection to said hydraulic means.

7. The apparatus, as claimed in claim 6, wherein each of said legs includes;

an outer member connected to the base floor;

a flange hingedly connected to said outer member immediately above the bin floor; and an inner member telescopically movable relative to said outer member, said flange removably connected to said inner member so that, upon disconnection from said inner member, said flange pivots to be substantially parallel to the bin floor.

8. The apparatus, as claimed in claim 6, wherein:

said support structure further includes a pair of pivotable gates connected to the base floor, each of said gates being removably connected to said lower portions of one of said legs so that, upon disconnection from said leg, said gates pivot to overlie one another substantially parallel to the base floor.

9. An apparatus for breaking up grain cake in a grain storage bin of the type including a housing, a base floor, a bin floor for supporting grain in the bin spaced above the base floor, a conveyor located between the base floor and the bin floor extending across the bin and through the housing for discharging grain from the bin, and at least one opening in the bin floor above the conveyor through which grain from the bin is fed to the conveyor, said apparatus including:

a plurality of legs connected to the base floor, each of said legs including an outer member and an inner member telescopically movable within said outer member to adjust the upward extent of said leg, said legs converging together at their upper portions at a distance above the base floor;

a hydraulic cylinder joined to the upper portions of said legs and having a hose connected thereto, said hose communicating with a source of hydraulic power, said hydraulic cylinder including a rod extending generally vertically in a downwardly direction from said upper portions of said legs;

an elongated, nonrotatable shaft having an upper end and a lower end, said shaft being adjustably connected to said rod adjacent said upper end for reciprocal movement in a generally vertical direction when said hydraulic cylinder is activated, said shaft being positioned generally directly above the opening in the bin floor; and a plurality of cutting arms connected to said shaft and extending radially therefrom to define a generally circular arrangement for loosening caked grain into the conveyor, a cutting arm being attached to said lower end of said shaft transverse to the longitudinal extent of the conveyor to facilitate the movement of the grain immediately adjacent the conveyor.

* * * * *